United States Patent [19]

Zehnder

[11] Patent Number: 4,565,135

[45] Date of Patent: Jan. 21, 1986

[54] CENTER SILL, FOR ACCOMMODATING THE COUPLING FACILITIES OF A RAILROAD CAR

[75] Inventor: Jürg Zehnder, Uitikon, Switzerland

[73] Assignee: Swiss Aluminium Ltd., Chippis, Switzerland

[21] Appl. No.: 481,760

[22] Filed: Apr. 4, 1983

[30] Foreign Application Priority Data

Apr. 15, 1982 [CH] Switzerland ..... 2279/82

[51] Int. Cl.[4] ..... B61F 1/00; B61F 1/08

[52] U.S. Cl. ..... 105/420; 105/416; 105/418; 213/50

[58] Field of Search ..... 105/417, 418, 416, 420, 105/414, 413, 396, 421; 213/50, 51; 403/109, 360

[56] References Cited

U.S. PATENT DOCUMENTS

| | | | |
|---|---|---|---|
| 2,904,769 | 7/1953 | Sampson | 403/360 |
| 2,946,297 | 7/1960 | Dean | 105/418 |
| 3,561,370 | 2/1971 | Reynolds | 105/420 |
| 3,737,136 | 6/1973 | Snurr | 403/109 |
| 4,287,834 | 9/1981 | Zehnder | 105/420 |

FOREIGN PATENT DOCUMENTS

| | | | |
|---|---|---|---|
| 0599828 | 6/1960 | Canada | 213/50 |
| 0649238 | 1/1951 | United Kingdom | 213/51 |

*Primary Examiner*—David A. Scherbel
*Assistant Examiner*—Dennis C. Rodgers
*Attorney, Agent, or Firm*—Bachman & LaPointe

[57] ABSTRACT

A center sill for accommodating coupling facilities on a railcar comprises two substantially Z-shaped hollow sections each having an upper section strip and a lower section strip joined by a connecting member. The Z-shaped hollow sections are arranged mirror image to each other and joined at the upper section strips. Each hollow section part features a connecting member having a pair of sidewalls joining the upper and lower strips and hollow chambers formed by transverse struts running between the sidewalls. To improve its rigidity, fatigue and tensile strength and to make assembly of the sill easier, the hollow section is cut away close to one end of the railcar and a reinforcing tubular shaped part is inserted into this recess. The cut runs preferably along the lower side of the transverse strut next to upper section strip, along the upper side of the lower section strip, and between these cuts approximately perpendicular across the chambers. A tongue on the reinforcing tubular shaped part fits over the outer surface of a sidewall. A stop on the part comes to rest against the cut edges of the chambers which it at least partly covers.

5 Claims, 5 Drawing Figures

CENTER SILL, FOR ACCOMMODATING THE COUPLING FACILITIES OF A RAILROAD CAR

BACKGROUND OF THE INVENTION

The invention relates to a center sill in the form of a longitudinal beam for accommodating the coupling facilities on a railroad car, the said sill comprises two Z-shaped hollow sections each having an upper section strip and a lower section strip joined by a connecting member. The Z-shaped hollow sections are arranged in mirror image and joined together along their upper section strips. Each hollow section part features a connecting member having a pair of the longitudinal sidewalls joining upper and lower strips and hollow chambers formed by transverse struts running between the sidewalls.

U.S. Pat. No. 4,287,834 shows a a center beam or sill in which a recess has been machined out of the part close to the end of the car to accommodate coupling facilities. Adapter and wear plates reinforce the end of the recess away from the end of the car. In practice it has been found expensive and difficult to install these plates.

The object of the present invention is to develop a center sill as set forth above wherein its assembly is made easier, the stiffness and the resistance to failure by bending of the sill are not diminished but increased and, at the same time, with no loss in strength.

SUMMARY OF THE INVENTION

The foregoing object is achieved by way of the present invention in that close to an end of the railcar a specific length of the hollow section is cut away to form a recess into which a reinforcing tubular shaped part such as a casting is inserted at a particular height.

It is also within the scope of the present invention that the cut in the hollow section runs along the lower side of the first transverse strut near the upper strip and subsequently approximately perpendicular across the other hollow chambers. It is, however, also possible to run the cut along the upper side of the lower strip and then approximately perpendicular across the hollow chambers. It has been found particularly advantageous to run the cut along the underside of the first tranverse strut near the upper strip of the section and along the upper side of the lower strip of the section as well as approximately perpendicular across the hollow chambers between these two cuts.

The foregoing arrangement has the advantage that the reinforcing tubular shaped part can be introduced from outside between the residual shaped parts of the center sill. The basic connection between the center sill and the reinforcing tubular shaped part is provided thus by weld seams running in the longitudinal direction of the sill, as a result of which the tensile strength of the whole center sill is improved.

In accordance with the present invention, provision is made for the reinforcing tubular shaped part, after it has been inserted into the recess in the center sill, to have a tongue of a particular length and height which engages over the outer face of the outer longitudinal strut of the hollow section part. The tongue can then be secured in place by a weld made from outside.

The depth to which the reinforcing tubular shaped part can be inserted is limited by a stop of a particular thickness which comes to rest against the cut part of the section at the hollow chambers. This stop covers the cut section partially or wholly. At the same time it provides a stop for the coupling facility and, when worn, can be easily changed along with the reinforcing tubular shaped part.

The reinforcing tubular shaped part also features projections to limit the movement of the coupling facility within the recess in the sill, and a straight piece of section positioned between the projections and the stop.

The end of the reinforcing tubular shaped part is delimited by a strip at the edge.

Altogether this arrangement exhibits superior rigidity than known center sills, in particular when cutting, and superior resistance to failure by bending when in service.

BRIEF DESCRIPTION OF THE DRAWINGS

Further advantages, features and details of the present invention are revealed in the following description of preferred exemplified embodiments and with the aid of the drawings wherein.

DETAILED DESCRIPTION

Figure 1:
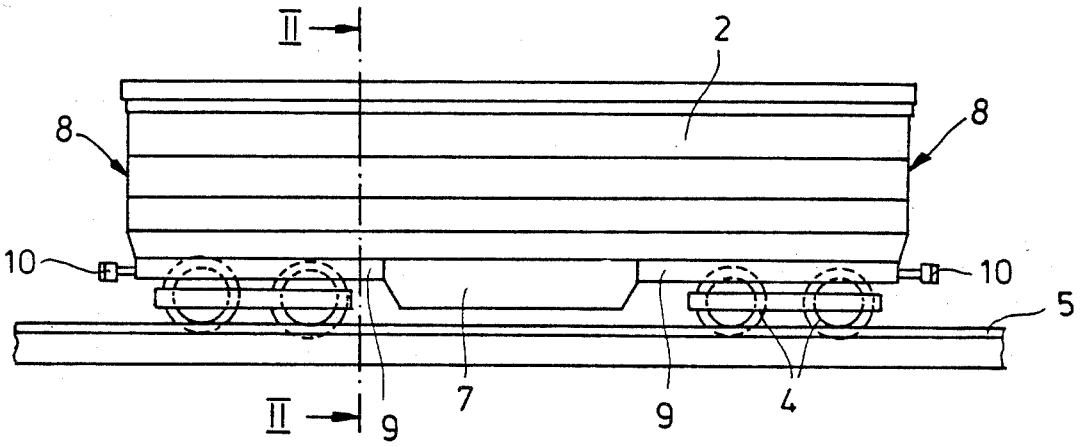
FIG. 1: Is a schematic front elevation of a railway hopper car.

A railway hopper car, in particular for transporting goods, features a superstructure 2 mounted on a base part 1. The car is mounted on rails 5 by wheels 4.

On the lower side 6 (FIG. 2) of the base 1, at about the middle of the car is a tank 7 from each end of which a center sill 9 runs to the end 8 of the hopper car. Coupling elements 10 projects out of the center sills 9.

Figure 2:
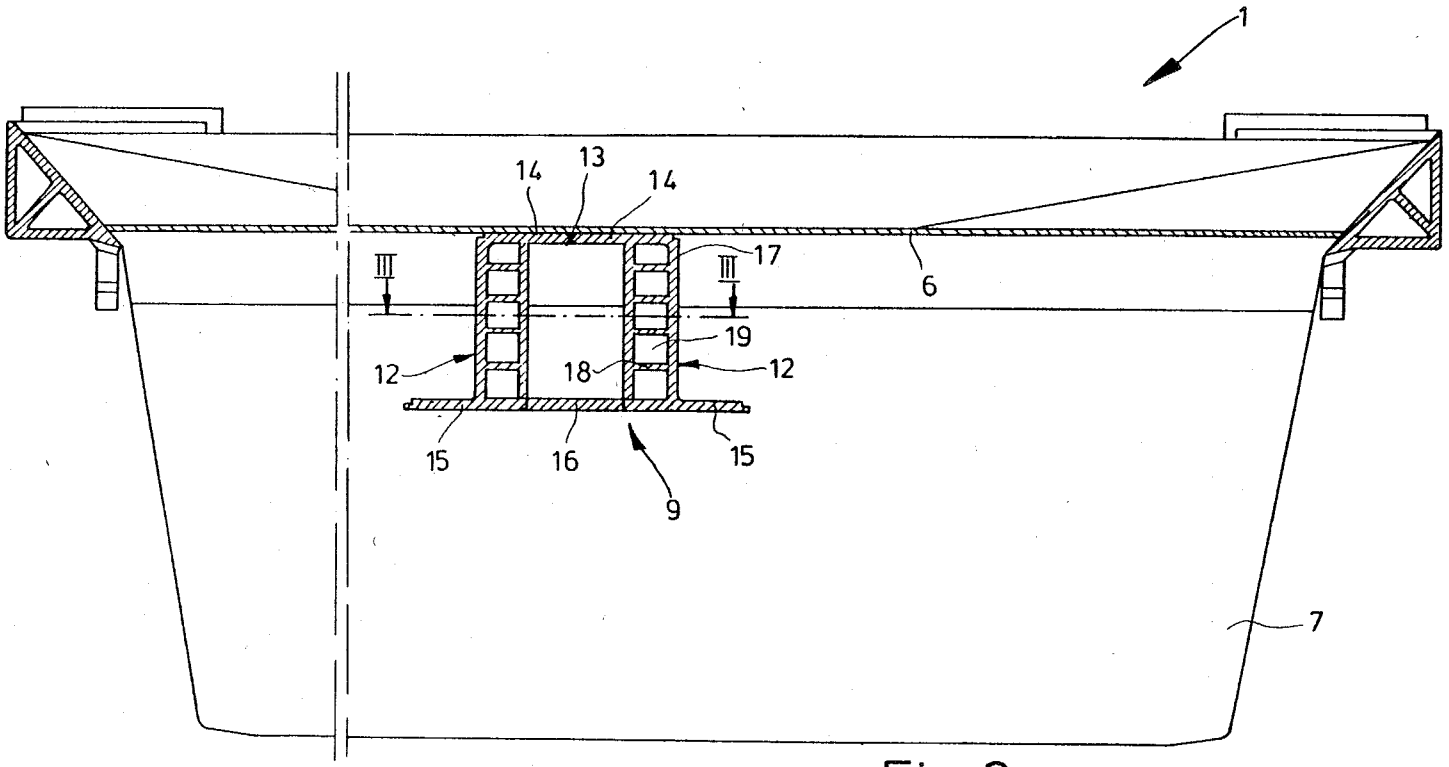
FIG. 2: Is an enlarged cross section through a hopper car floor along line II—II in FIG. 1.

As shown in FIG. 2, the center sills 9 are made up of two Z-shaped hollow sections 12 each having an upper section strip and a lower section strip joined by a connecting member. The Z-shaped hollow sections are arranged in mirror image and joined together by a weld seam 13 on the upper section strips 14 at the underside 6 of the base 1. The lower section strips 15 are joined by a base plate 16.

Joining the upper and lower section strips 14 and 15 is a connecting member having two longitudinal struts 17 which, along with transverse structs 18 running between them, form five hollow chambers 19.

Figure 4:
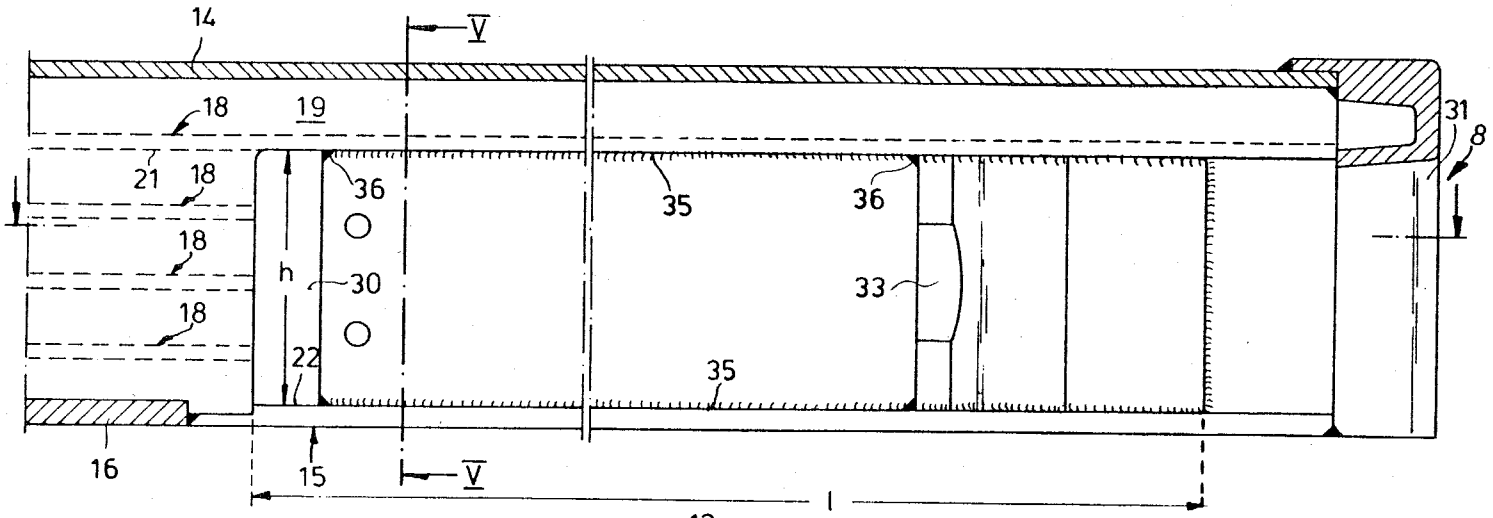
FIG. 4: Is a longitudinal section through a center sill along line IV—IV in FIG. 3.

Such longitudinal center sills 9 extend, depending on the type of railcar, either over the whole length of the car or from the tank 7 to the end 8 of the car. However, in both cases the center sill 9 is cut away a length 1 close to the end 8 (FIG. 4). The cut runs along the lower side 21 of the transverse strut 18 closest to the upper section strip 14 and, after running length 1, runs across the four subsequent hollow chamber 19, then along the upper side 22 of the lower section strip 15 again to end 8. The chamber 19 next to strip 14 of the section remains unaffected.

Figure 3:
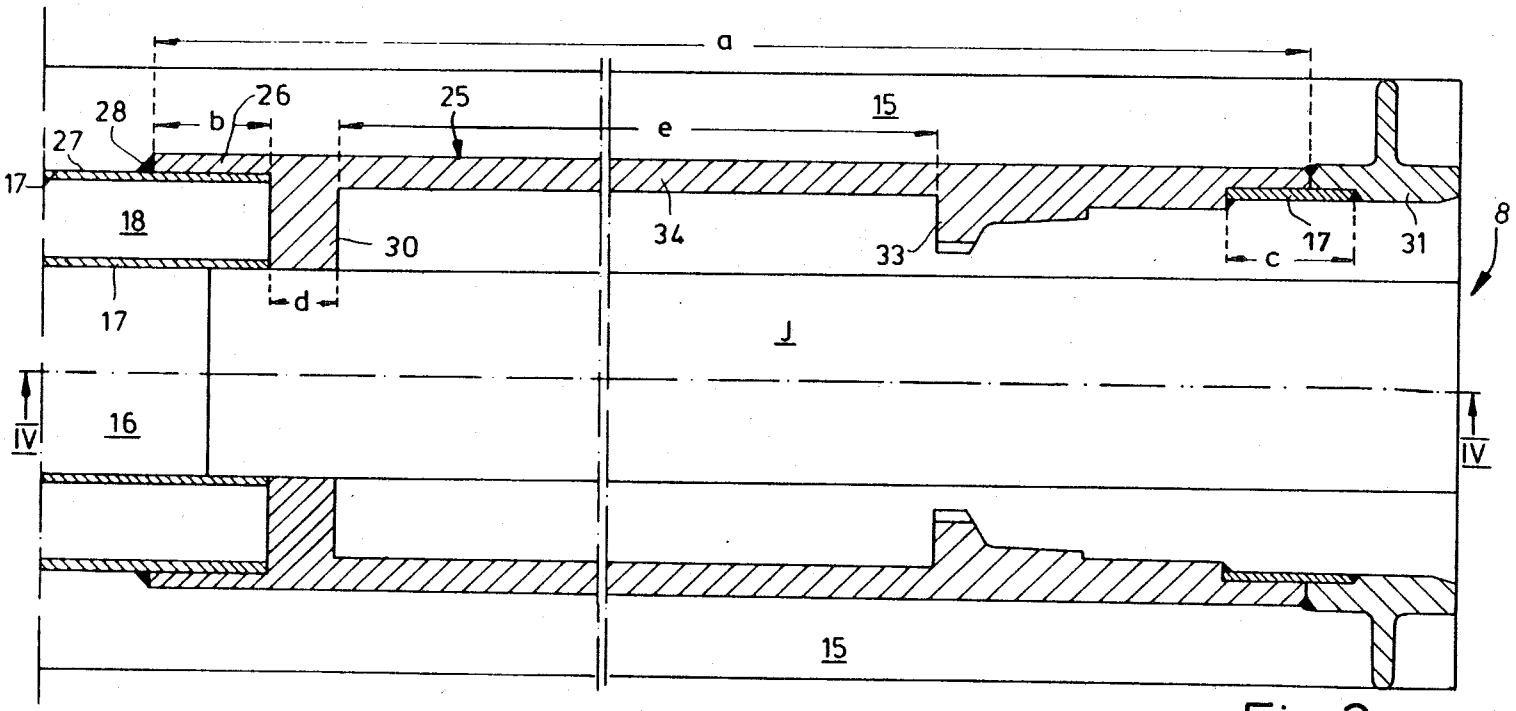
FIG. 3: Is an enlarged cross section through part of a center sill of a railway hopper car along line III—III in FIG. 2.
Figure 5:
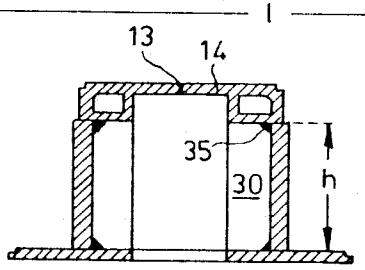
FIG. 5: Is a cross section through a center sill along line V—V in FIG. 4.

Inserted into this recess of height h is a reinforcing tubular shaped part 25 of height h and length a which features a tongue 26 (FIG. 3) that extends a length b over the outer face 27 of the outer longitudinal wall 17 of the hollow section 12, and is secured in place there by a weld 28. A stop 30 of thickness d on the reinforcing tubular shaped part 25 comes to rest against the transversely cut section parts and, as shown particularly well in FIG. 5, covers these cut faces.

Towards end 8 the reinforcing tubular shaped part 25 is welded to a T-shaped edge piece 31 and to a remaining part of the sidewall 17 of length c. Part 25, edge piece 31 and the part of the side wall 17 delimit a space J which accommodates a coupling facility, not shown here, and features projections 33 on the reinforcing tubular shaped part 25 for limiting the movement of the coupling facility. The main part of the reinforcing tubular shaped component 25 is a straight, plate-shaped piece 34 of length e between stop 30 and projection 33.

The reinforcing tubular shaped component 25 is secured in place by longitudinal welds 35 on the underside 21 of transverse strut 18 and on the upper side 22 of the lower section strip 15. Further welds 36 are provided on the stop 30 and projections 33.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A center sill of a railcar for accommodating coupling facilities comprising two substantially Z-shaped hollow sections arranged in mirror image to each other, said substantially Z-shaped hollow sections each having an upper section strip and a lower section strip joined by a connecting member wherein said two substantially Z-shaped hollow sections are joined together at their upper section strips, each of the connecting members of said substantially Z-shaped hollow sections have a pair of substantially parallel spaced apart longitudinal struts being connected by a plurality of transverse struts which define with said longitudinal struts a plurality of hollow chambers wherein said center sill at the ends close to the end of the railcar is provided with a recess of length 1 and height h which receives a reinforcing shaped part wherein said recess runs along the lower side of the first transverse strut of said plurality of transverse struts next to the upper section strip of said substantially Z-shaped hollow sections, then substantially perpendicular across at least one of said plurality of hollow sections, then along the upper side of the lower section strip of said substantially Z-shaped hollow sections and then substantially perpendicular across at least one of said plurality of hollow sections such that the recess runs in a transverse direction over the entire profile of the center sill.

2. A center sill according to claim 1 wherein said reinforcing shaped part is provided with a tongue on one end thereof adapted to be received over the outer face of the connecting member of each of the opposed said substantially Z-shaped hollow sections.

3. A center sill according to claim 1 wherein said reinforcing shaped part is tubular in shape and is provided on the inside thereof with stops adapted to abut said longitudinal struts and said transverse struts which define said plurality of hollow chambers.

4. A center sill according to claim 3 wherein the interior of said reinforcing tubular shaped part is provided with projections.

5. A center sill according to claim 1 wherein said reinforcing shaped part is welded within said recess.

* * * * *